United States Patent [19]

Soga

[11] 4,309,860

[45] Jan. 12, 1982

[54] MACHINE FOR CLOSING A RECEPTACLE

[75] Inventor: George Soga, Laval, Canada

[73] Assignee: Soga Packaging Machinery Co., Ltd., Montreal North, Canada

[21] Appl. No.: 138,848

[22] Filed: Apr. 10, 1980

[51] Int. Cl.[3] ..... B65B 7/28

[52] U.S. Cl. ..... 53/76; 53/366; 413/51; 493/109

[58] Field of Search ..... 53/366, 76, 341, 348, 53/281, 282, 69; 113/120 Y, 30, 1 E, 1 N; 493/108, 109, 158, 103

[56] References Cited

U.S. PATENT DOCUMENTS

| | | | |
|---|---|---|---|
| 2,012,529 | 8/1935 | Eldredge | 53/366 X |
| 2,539,389 | 1/1951 | Almgren et al. | 493/109 X |
| 2,767,537 | 10/1956 | Prince et al. | 53/366 |
| 2,845,765 | 8/1958 | Doherty | 53/366 |
| 2,886,933 | 5/1959 | Hennies, Jr. | 53/366 X |
| 3,263,393 | 8/1966 | Weber | 53/366 X |
| 3,336,729 | 8/1967 | Logemann | 53/366 |
| 3,355,858 | 12/1967 | Jahn | 53/366 X |
| 3,369,342 | 2/1968 | Tessitore | 53/366 |
| 3,435,588 | 4/1969 | Johnson, Jr. et al. | 53/366 |
| 3,445,988 | 5/1969 | Maier et al. | 53/366 X |
| 3,816,973 | 6/1974 | Baker | 53/287 |
| 3,835,799 | 9/1974 | Huth et al. | 113/1 E |
| 4,078,360 | 3/1978 | Balzer et al. | 53/76 |

FOREIGN PATENT DOCUMENTS

| | | | |
|---|---|---|---|
| 1227825 | 10/1966 | Fed. Rep. of Germany | 53/366 |

*Primary Examiner*—James F. Coan

*Attorney, Agent, or Firm*—Fleit & Jacobson

[57] ABSTRACT

The invention relates to apparatus for securing covers to metal foil containers, and for sealing the containers. The containers are of the type which have an open top, a horizontal flange surrounding the open top, and a peripheral vertical flange surrounding the horizontal flange, and the cover rests on the horizontal flange. The apparatus includes a stationary platform, on which the unsealed container rests, and a ring which surrounds the platform. The ring is vertically movable, and the top surface of the ring engages the horizontal flange of the container to move the container with it. Located above the ring is a die with an inner camming surface, and the ring will move the container upward so that the vertical flanges of the container engage the inner camming surface to crimp the flange inwardly and downwardly. A press then moves downwardly through an opening in the die to press the crimped flange down so that the cover is secured to the container and the container is sealed.

7 Claims, 6 Drawing Figures

MACHINE FOR CLOSING A RECEPTACLE

BACKGROUND OF THE INVENTION (a) Field of the Invention

The invention relates to an apparatus for securing a cover to, and sealing, a metal foil container, which container has an open top, a horizontal flange surrounding the open top, the cover being disposed on the horizontal flange, and an upwardly extending peripheral flange surrounding the horizontal flange, the peripheral flange being crimped to secure the cover and seal the container. More specifically, the invention relates to such an apparatus wherein the securing and sealing are performed at a single station in a single operation.

(b) Description of Prior Art.

Known in the art are machines which automatically fill and close containers as above described. Such an apparatus is described in U.S. Pat. No. 3,445,988, Maier et al, May 27, 1969 and No. 3,816,973, Baker, June 18, 1974. However, some products are not suitable for automatic filling, and such machines could not be used with such products. In addition, there are plants whose productivity is too low to justify the cost of the complex machinery as described in Maier et al. In these cases, the containers would be hand filled. However, even in these cases, because of the difficulty in the process of securing the cover and sealing the container by hand, an apparatus to perform this function automatically and mechanically would be desirable.

U.S. Pat. Nos. 3,263,393, Weber, Aug. 2, 1966, 3,435,588, Johnson et al, Apr. 1, 1969, 3,835,799, Huth et al, Sept. 17, 1974, and 3,355,858, Jahn, Dec. 5, 1967, all relate to apparatus which perform only the securing and sealing function. However, all of these machines use continuous closing processes so that the machines are complex and costly. In addition, the sealing and securing is performed continuously at a plurality of stations.

U.S. Pat. Nos. 2,539,389, Almgren et al, Jan. 30, 1951, 3,369,342, Tessitore, Feb. 20, 1968, 2,845,765, Doherty, Aug. 5, 1958, and 2,767,537, Prince et al, teach apparatus which perform the securing and sealing function at a single station, but not in a single operation. Thus, these patents rely on moving fingers or rollers to perform the crimping operation necessary for securing and sealing.

Of interest in the art are U.S. Pat. Nos. 3,336,729, Logemann, Aug. 22, 1967 and 2,012,529, Eldredge, Aug. 27, 1935, which relate generally to the process of securing and sealing with respect to metal foil containers.

SUMMARY OF THE INVENTION

In accordance with an embodiment, an apparatus for securing covers to, and sealing, metal foil containers, each of which containers includes an open top, a horizontal flange surrounding the open top, and an upwardly extending peripheral flange surrounding the horizontal flange, each cover being disposed on the horizontal flange of its respective container; said apparatus comprising; a first station comprising a presecuring and sealing station; a second station comprising a securing and sealing station disposed on one side of said first station; means for moving containers, one at a time, from said first station to said second station, disposed on the other side of said first station; conveyor means at one end of said first station for conveying unsealed containers to said first station; means for detecting the presence of a container in said first station and for activating said means for moving when a container is detected in said first station; whereby, when a container is detected in said first station, said means for moving will be activated to move said container from said first station to said second station; said second station comprising; a stationary platform at substantially the same level as the top surface of said first station; a ring means surrounding said platform, the outer edge of said ring means, as seen in top view, having substantially the same shape and dimensions as the outer edge of said container, as seen in top view; means for imparting vertical motion to said ring means; a die disposed vertically above said ring and having an inner camming surface, the bottom edge of said camming surface having substantially the same shape and dimensions as the outer edge of said ring means; an opening extending vertically through said die, said opening being of the same shape as, but of smaller dimensions than, the bottom edge of said camming surface, and being concentric therewith; press means disposed for passage through said opening of said die, said press means having the same shape as said opening of said die and being dimensioned for easy clearance therethrough; means for imparting vertical motion to said press means; means for activating the means for imparting vertical motion to the ring means when the container is moved from the first station to the second station; and means for activating the means for imparting vertical motion to the press means when the container is at the top edge of the camming surface; whereby, when the container is moved from the first station to the second station, the top surface of the ring will engage the horizontal flange of the container and move the container upwardly so that the vertical flange thereof will engage the camming surface of the die and be crimped inwardly and downwardly; and whereby, when the container is at the top edge of the camming surface, the press means will move downwardly on the top of the crimped peripheral flange to force it level with the top surface of the container cover to thereby secure the cover to the container and to seal the container. The means for moving said container from said first station to said second station may comprise a piston and cylinder arrangement being disposed such that the piston points in the direction of said second station; and a plate disposed at the free end of said piston and mounted transversely thereto. The means for detecting the presence of a container in said first station may comprise a movable wall at the other end of said first station; and switch means may be located on the side of said wall opposite said first station; whereby, when a container arrives in said first station from said conveyor means, it will move said wall to turn on said switch means. The means for imparting vertical motion to said ring means may comprise a vertically mounted piston and cylinder arrangement disposed below said ring means. A plate may be mounted at the free end of the piston of said piston and cylinder arrangement and transversely thereto, the top surface of said plate engaging the bottom edge of said ring; whereby the ring will move with the motion of said piston. The means for imparting vertical motion to said press means may comprise a vertically mounted piston and cylinder arrangement disposed above said press means. The apparatus may further comprise at least one opening extending vertically through said press means; a rod extending through said opening in said press means; said rod being movable slightly in advance of said press means; whereby the bottom surface of said rod will contact the cover in advance of the bottom surface of said press means.

BRIEF DESCRIPTION OF THE DRAWINGS

The invention will be better understood by an examination of the following description, together with the accompanying drawings, in which.

DESCRIPTION OF PREFERRED EMBODIMENTS

Figure 1:
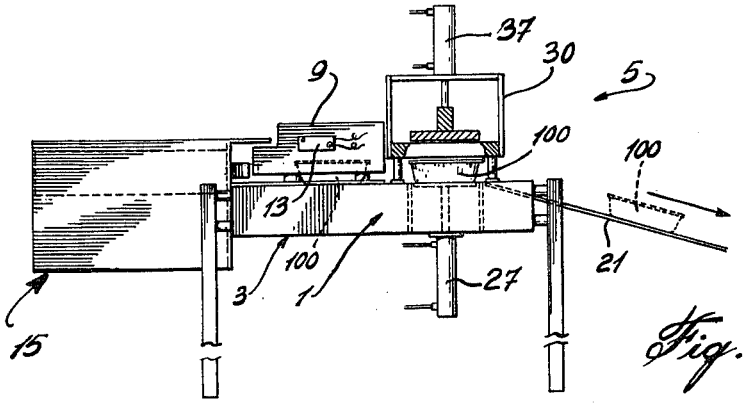
FIG. 1 is an end view of an apparatus in accordance with the invention.
Figure 2:
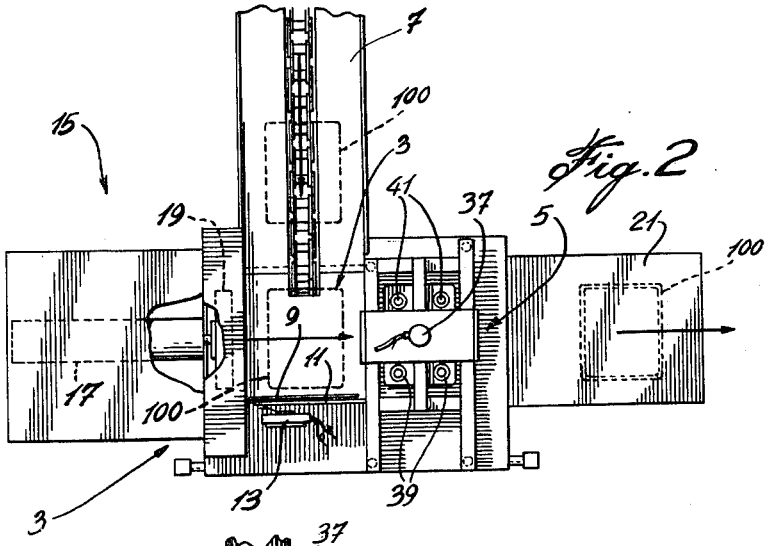
FIG. 2 is a top view of the apparatus of FIG. 1.
Figure 3:
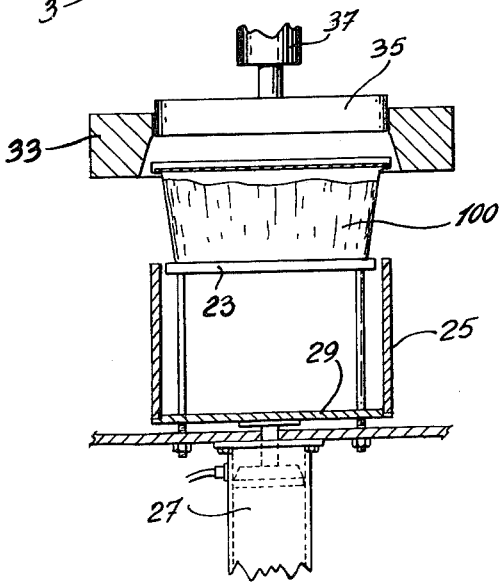
FIG. 3 is a section through III—III of FIG. 2.

Referring now to the figures, the apparatus is supported by means such as Table 1 and comprises a pre-securing and sealing station 3 and a securing and sealing station 5. Containers 100 are brought to one end of the station 3 by conveyor means such as an endless belt 7. At the other end of the station 3 is a means for detecting the presence of a container in the station 3 consisting of, in the drawings, a movable wall 9 which surrounds fixed wall 11 and is movable relative thereto. Switch 13 is disposed on the open side of the wall 9 and is actuable by movement of the wall as will be explained below.

As seen in the drawings, the station 5 is disposed on one side of the station 3. Disposed on the other side of the station 3 is a means 15 for moving containers from the station 3 to the station 5 comprising a piston and cylinder arrangement 17 whose free end of the piston is terminated by a plate 19. The piston and cylinder arrangement may be hydraulically operated.

Disposed on the side of the station 5, opposite from the side of station 5, is a slide 21.

The securing and sealing station comprises a stationary platform 23, which is at substantially the same level as the top surface of the pre-securing and sealing station 3. Surrounding the platform 23 is a vertically movable ring 25. The ring is moved by the piston and cylinder arrangement 27, the free end of whose piston is terminated by plate 29 which is disposed on the underside of the ring 25.

The outer edge of the ring, as seen in top view, has the same shape as the outer edge of the container, as seen in top view, and is dimensioned so that, in operation, it will engage, and make contact with, the horizontal flange of the container.

Stand 30, of station 5, is disposed above the ring and supports die 3, which includes an inner camming surface 33*a*. The bottom edge of the camming surface defines a shape which is substantially identical to the shape of the outer edge of the container to be sealed as seen in top view and which has substantially the same dimensions. The die includes an opening which is the same shape as, and concentric with, the shape defined by the bottom edge of the camming surface of the die. The die is disposed above the ring so that the bottom edge of the camming surface is in line with the outer edge of the ring. Disposed for passage through the opening in the die is a press means 35 which is the same shape as the opening and is dimensioned to pass through the opening with easy clearance. The press means is moved vertically by the piston and cylinder arrangement 37.

In operation, the apparatus works as follows:

The containers 100, which are of the type as illustrated in the above-mentioned patents, are filled at filling stations, which may be disposed along the length of the conveyor belt ahead of the station 3, and the cover 101 is manually placed on the horizontal flange surrounding the open top thereof. It is in this covered condition that each container is brought to the station 3, and the speed of the conveyor must be great enough so that the momentum of the container will carry it to the wall 9 and cause it to push the wall in the direction of the switch 13 to turn the switch on.

When switch 13 is turned on, it activates the piston and cylinder arrangement 17 by means not shown but well known in the art, so that the piston extends out of the cylinder thereof and moves the plate 19 in the direction of the station 5. The plate 19 will push a container 100, in the station 3, to station 5. The securing and sealing station will now be activated by, for example, the return movement of the plate 19 or by activation of the switch S shown in FIG. 1.

Figure 4A:
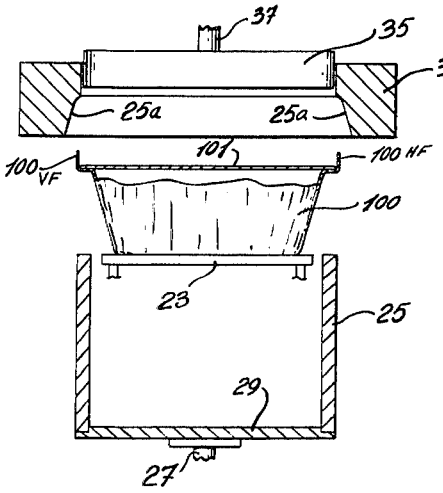
FIGS. 4*a* to 4*c* are schematic representations useful in understanding the operation of apparatus in accordance with the invention.
Figure 4B:
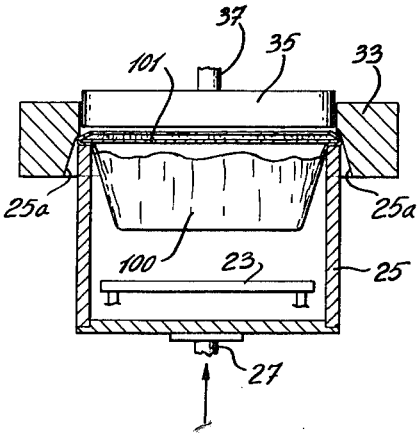

Before the station 5 is activated, the relative position of its parts and a container 100 is shown in FIG. 1*a*. Upon activation, the first action is the activation of piston and cylinder arrangement 27 to lift the ring 25 upwardly, as shown in FIG. 4*b*. As also seen in FIG. 4*b*, the top edge of the ring 25 engages the horizontal flange 100HF of the container 100, and thereby lifts the container upwardly as the ring moves upwardly. In the upward motion of the container, the vertical flanges, 100VF, of the container make contact with the camming surface of 33*a* of the die 33 and are crimped inwardly and downwardly by the camming surface.

Figure 4C:
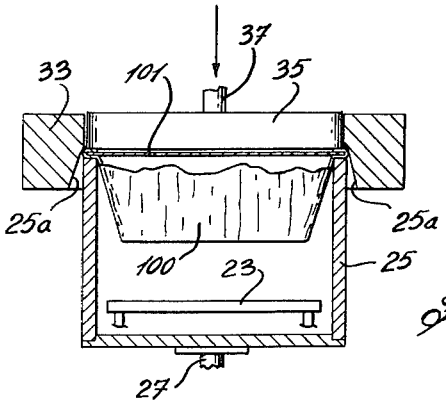

When the container is substantially at the top edge of the camming surface, as seen in FIG. 4*c*, piston and cylinder arrangement 37 is activated to move press 35 downwardly on the top surface of the crimped peripheral flange to force it level with the top surface of the cover so as to secure the cover and seal the container. The piston and cylinder is activated by means which detect the vertical position of the ring 25, for example, a switch at the top edge of the camming surface 33*a*.

When the next container is pushed from station 3 to station 5, the sealed container will be pushed out of station 5 onto slide 21 to either a further conveyor or a container for sealed containers.

In a further embodiment of the invention, when the cover 101 of the container has a tendency to buckle instead of lying flat after the container is filled and before the cover has been secured and the container sealed, the press means includes a plurality of openings 39 extending vertically therethrough. Extending through the openings are rods 41 which are activated to move downward slightly in advance of the press means, and whose downward motion ceases when the bottom surfaces thereof are at the same level as the bottom surface of the press means is when its downward motion ceases. The rods are disposed over areas of the cover which tend to buckle outwardly.

In operation of this embodiment, the rods will hit the cover in advance of the press means to push down on the areas under them to level the buckled areas and to align the entire surface of the cover.

Although several embodiments have been described, this was for the purpose of illustrating, but not limiting, the invention. Various modifications, which will come readily to the mind of one skilled in the art, are within the scope of the invention as defined in the appended claims.

I claim:

1. Apparatus for securing covers to, and sealing, metal foil containers, each of which containers includes an open top, horizontal flange surrounding the open top, and an upwardly extending peripheral flange surrounding the horizontal flange, each cover being disposed on the horizontal flange of its respective container;

said apparatus comprising;

a first station comprising a pre-securing and sealing station;

a second station comprising a securing and sealing station disposed on one side of said first station;

means for moving containers, one at a time, from said first station to said second station, disposed on the other side of said first station;

conveyor means at one end of said first station for conveying unsealed containers to said first station;

means for detecting the presence of a container in said first station and for activating said means for moving when a container is detected in said first station;

whereby, when a container is detected in said first station, said means for moving will be activated to move said container from said first station to said second station;

said second station comprising;

a stationary platform at substantially the same level as the top surface of said first station;

a ring means surrounding said platform, the outer edge of said ring means, as seen in top view, having substantially the same shape and dimensions as the outer edge of said container, as seen in top view;

means for imparting vertical motion to said ring means;

a die disposed vertically above said ring means and having an inner camming surface, the bottom edge of said camming surface having substantially the same shape and dimensions as the outer edge of said ring means;

an opening extending vertically through said die, said opening being of the same shape as, but of smaller dimensions than, the bottom edge of said camming surface, and being concentric therewith;

press means disposed for passage through said opening of said die, said press means having the same shape as said opening of said die and being dimensioned for easy clearance therethrough;

means for imparting vertical motion to said press means;

means for activating the means for imparting vertical motion to the ring means when the container is moved from the first station to the second station; and means for activating the means for imparting vertical motion to the press means when the container is at the top edge of the camming surface;

whereby, when the container is moved from the first station to the second station, the top surface of the ring will engage the horizontal flange of the container and move the container upwardly so that the vertical flange thereof will engage the camming surface of the die and be crimped inwardly and downwardly; and whereby, when the container is at the top edge of the camming surface, the press means will move downwardly on the top of the crimped peripheral flange to press it level with the top surface of the container cover to thereby secure the cover to the container and to seal the container.

2. Apparatus as defined in claim 1 wherein said means for moving said container from said first station to said second station comprises a piston and cylinder arrangement being disposed such that the piston points in the direction of said second station; and a plate disposed at the free end of said piston and mounted transversely thereto.

3. Apparatus as defined in claim 1 wherein said means for detecting the presence of a container in said first station comprises a movable wall at the other end of said first station; and switch means on the side of said wall opposite said first station;

whereby, when a container arrives in said first station from said conveyor means, it will move said wall to turn on said switch means.

4. Apparatus as defined in claim 1 wherein said means for imparting vertical motion to said ring means comprises a vertically mounted piston and cylinder arrangement disposed below said ring means.

5. Apparatus as defined in claim 4 wherein a plate is mounted at the free end of the piston of said piston and cylinder arrangement and transversely thereto, the top surface of said plate engaging the bottom edge of said ring;

whereby the ring will move with the motion of said piston.

6. Apparatus as defined in claim 1 wherein the means for imparting vertical motion to said press means comprises a vertically mounted piston and cylinder arrangement disposed above said press means.

7. Apparatus as defined in claim 1 and further comprising at least one opening extending vertically through said press means;

a rod extending through said opening in said press means;

said rod being movable downward slightly in advance of said press means;

whereby the bottom surface of said rod will contact the cover in advance of the bottom surface of said press means.

* * * * *